US008357868B2

(12) United States Patent
Soininen et al.

(10) Patent No.: US 8,357,868 B2
(45) **Date of Patent: *Jan. 22, 2013**

(54) CONTROLLER UNIT FOR SWITCHING DEVICE

(75) Inventors: Matti Soininen, Jukaja (FI); Aki Suutarinen, Vaasa (FI)

(73) Assignee: ABB Oy, Helsinki (FI)

( * ) Notice: Subject to any disclaimer, the term of this patent is extended or adjusted under 35 U.S.C. 154(b) by 95 days.

This patent is subject to a terminal disclaimer.

(21) Appl. No.: 12/973,028

(22) Filed: Dec. 20, 2010

(65) Prior Publication Data

US 2011/0147185 A1 Jun. 23, 2011

Related U.S. Application Data

(63) Continuation of application No. PCT/FI2009/050511, filed on Jun. 12, 2009.

(51) Int. Cl.
*H01H 3/08* (2006.01)

(52) U.S. Cl. ..... 200/336

(58) Field of Classification Search ..... 200/400, 200/336, 329, 50.21, 17 R, 50.32
See application file for complete search history.

(56) References Cited

U.S. PATENT DOCUMENTS

| | | | | |
|---|---|---|---|---|
| 2,797,591 | A | 7/1957 | Marrapese | |
| 5,438,176 | A * | 8/1995 | Bonnardel et al. | 200/400 |
| 5,886,311 | A | 3/1999 | Morel et al. | |
| 6,501,039 | B1 | 12/2002 | Mattlar et al. | |
| 6,940,032 | B2 * | 9/2005 | Sirajtheen et al. | 200/400 |
| 7,566,840 | B2 * | 7/2009 | Sudhakar et al. | 200/244 |
| 2007/0131528 | A1 | 6/2007 | Mattlar et al. | |
| 2011/0147183 | A1 * | 6/2011 | Soininen et al. | 200/329 |
| 2011/0147184 | A1 * | 6/2011 | Soininen et al. | 200/336 |

FOREIGN PATENT DOCUMENTS

| | | | |
|---|---|---|---|
| DE | 668433 | C | 12/1938 |
| EP | 1443534 | A1 | 8/2004 |
| EP | 1053553 | B1 | 5/2006 |
| GB | 695380 | A | 8/1953 |
| WO | WO 90/05375 | | 5/1990 |
| WO | WO 2005/069323 | A1 | 7/2005 |
| WO | WO 2005/069324 | A1 | 7/2005 |
| WO | WO 2005/076302 | A1 | 8/2005 |

OTHER PUBLICATIONS

International Search Report (PCT/ISA/210) issued on Oct. 7, 2009, by Finnish Patent Office as the International Searching Authority for International Application No. PCT/FI2009/050511.

(Continued)

*Primary Examiner* — Edwin A. Leon
(74) *Attorney, Agent, or Firm* — Buchanan Ingersoll & Rooney, P.C.

(57) ABSTRACT

Exemplary embodiments are directed to a controller unit for a switching device. The controller unit includes a body part and an operating axle. The operating axle is connected to contacts of the switching device to adjust a respective state of the contacts between a closed position and an open position. A control axle includes a first axle part and a second axle part, the first axle part is arranged to be turned by a user, and the second axle part is functionally connected to the operating axle to turn it between the open position and the closed position. A tripping assembly is functionally connected to the operating axle to turn the operating axle from the closed position to the open position. The controller unit also includes connecting means for functionally connecting a first axle part to one of a tripping assembly and a second axle part.

16 Claims, 8 Drawing Sheets

OTHER PUBLICATIONS

Written Opinion (PCT/ISA/237) issued on Oct. 7, 2009, by Finnish Patent Office as the International Searching Authority for International Application No. PCT/FI2009/050511.
Finnish Search Report dated Jan. 12, 2009 for Application No. FI20085618.
International Search Report (PCT/ISA/210) issued on Oct. 7, 2009, by Finnish Patent Office as the International Searching Authority for International Application No. PCT/FI2009/050512.
Written Opinion (PCT/ISA/237) issued on Oct. 7, 2009, by Finnish Patent Office as the International Searching Authority for International Application No. PCT/FI2009/050512.
Finnish Search Report dated Jan. 7, 2009, for Application No. 20085616.
International Search Report (PCT/ISA/210) issued on Oct. 7, 2009, by Finnish Patent Office as the International Searching Authority for International Application No. PCT/FI2009/050514.
Written Opinion (PCT/ISA/237) issued on Oct. 7, 2009, by Finnish Patent Office as the International Searching Authority for International Application No. PCT/FI2009/050514.
Finnish Search Report dated Jan. 9, 2009 for Application No. FI20085617.
Soininen, Matti, et al., U.S. Appl. No. 12/971,800, entitled "Tripping Assembly for Switching Device," filed in the U. S. Patent and Trademark Office on Dec. 17, 2010.
Soininen, Matti, et al., U.S. Appl. No. 12/971,833, entitled "Controller Unit for Switching Device," filed in the U. S. Patent and Trademark Office on Dec. 17, 2010.

* cited by examiner

= Manual control

= Tripping function

Mode symbols forming a mode code are associated with controller unit components or assemblies as follows:

| First axle part | - | Second axle part | - | Sleeve guide | - | Connecting sleeve | - | Tripping assembly | - | Operating axle |
|---|---|---|---|---|---|---|---|---|---|---|

CONTROLLER UNIT FOR SWITCHING DEVICE

RELATED APPLICATIONS

This application claims priority as a continuation application under 35 U.S.C. §120 to PCT/FI2009/050511, which was filed as an International Application on Jun. 12, 2009 designating the U.S., and which claims priority to Finnish Application 20085618 filed in Finland on Jun. 19, 2008. The entire contents of these applications are hereby incorporated by reference in their entireties.

FIELD

The disclosure relates to a controller, such as a controller unit for a switching device.

BACKGROUND INFORMATION

A switching device is a device with contact means for selectively producing an open state and a closed state in an electric circuit. The open position of the contact means is arranged to produce the open state in the electric circuit, and the closed position of the contact means is arranged to produce the closed state of the electric circuit. The controller unit of the switching device can include a control axle arranged to be turned by a user and functionally connected to the contact means of the switching device to adjust their state between the open position and the closed position. The switching device can also include a tripping assembly, which can be functionally connected to the contact means of the switching device in such that a tripping event of the tripping assembly can adjust the state of the contact means of the switching device from the closed position to the open position. The switching device can be provided with the tripping assembly such that the tripping assembly can be tensioned by turning the control axle to an on-position.

The tensioning of the tripping assembly by turning the control axle to the on-position can be problematic, because a relatively big torque is needed for turning the control axle. This problem is particularly big in switching devices with high rated currents, whereby the turning of the control axle is especially hard due to massive components.

SUMMARY

An exemplary embodiment is directed to a controller unit for a switching device. The controller unit includes a body part and an operating axle. The operating axle is turnable between a closed position and an open position in relation to the body part and is arranged to be functionally connectable to contacts of the switching device. The operating axle adjusts a state of each contact between the closed position and the open position. The controller unit also includes a control axle that includes a first axle part and a second axle part. The first axle part is arranged to be turned by a user and is turnable between an off-position and an on-position in relation to the body part. The second axle part is turnable between an off-position and an on-position in relation to the body part and is functionally connected to the operating axle to turn it between the open position and the closed position. The controller has a tripping assembly which has a trip state and a tensioned state. The tripping assembly is functionally connected to the operating axle such that the tripping event of the tripping assembly turns the operating axle from the closed position to the open position. The controller includes connecting means for functionally connecting a first axle part to one of a tripping assembly and a second axle part. The connecting means for functionally connecting a first axle part to one of a tripping assembly and a second axle part.

BRIEF DESCRIPTION OF THE DRAWINGS

The disclosure will now be described in greater detail in connection with the exemplary embodiments and with reference to the accompanying drawings, in which.

DETAILED DESCRIPTION

It is an object of the disclosure to provide a controller unit for a switching device so that the above mentioned problem can be solved.

The disclosure is based on dividing a control axle into two parts so that a first axle part of the control axle arranged to be turned by a user can be functionally connected separately to either a tripping assembly or a second axle part of the control axle. When the first axle part is functionally connected to the tripping assembly, the turning of the first axle part from the off-position to the on-position causes a tensioning event in the tripping assembly. When the first axle part is functionally connected to the second axle part, the turning of the first axle part from the off-position to the on-position makes the operating axle turn from the open position to the closed position, the turning of the operating axle, for its part, being arranged to adjust the state of contacts of the switching device from the open position to the closed position.

The controller unit of the disclosure provides the advantage that the maximum torque required for turning the control axle is smaller, because the tensioning of the tripping assembly and the changing of the state of the contacts from the open position to the closed position are carried out by entirely independent turning procedures of the first axle part.

Figure 1:
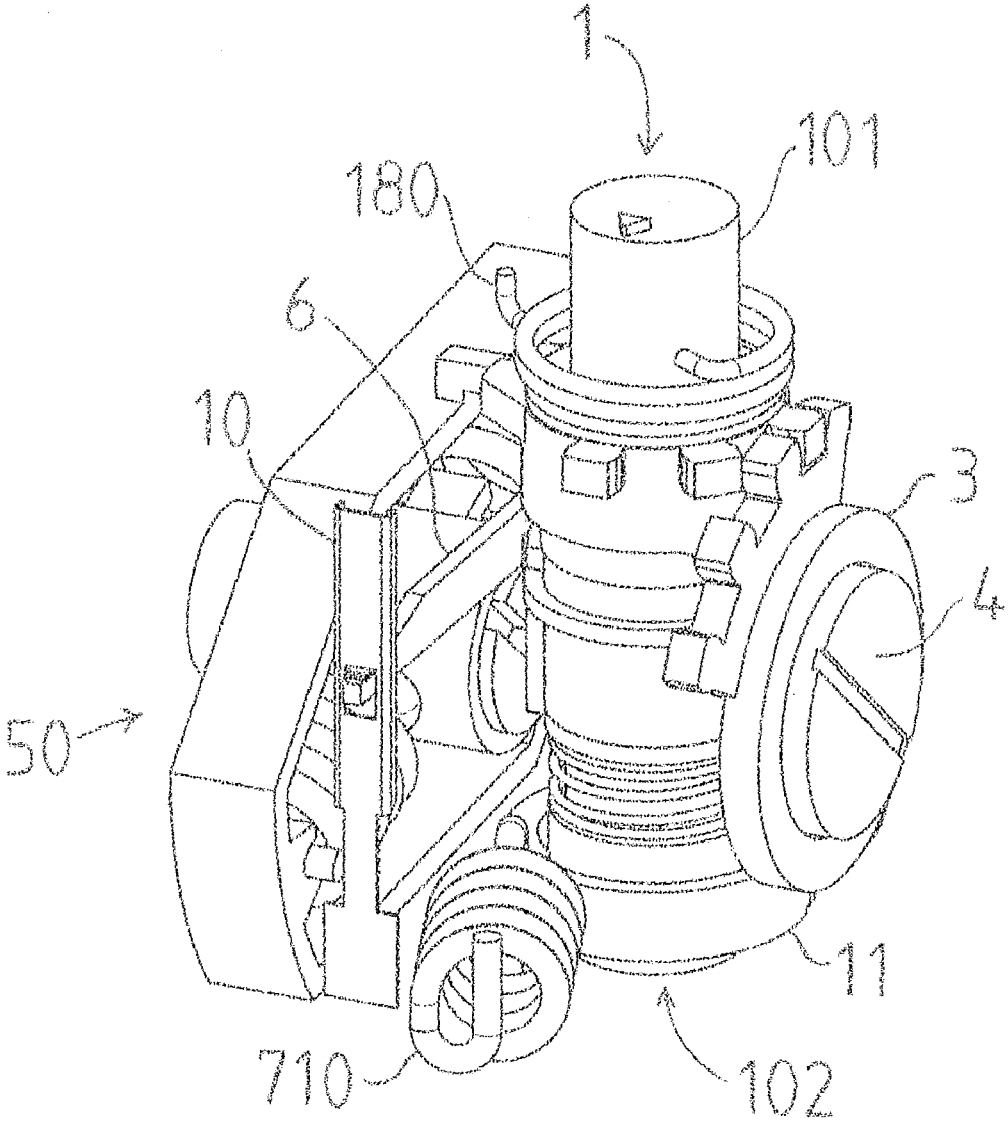
FIG. 1 shows a controller unit without a body part in accordance with an exemplary embodiment.

FIG. 1 shows a controller unit for a switching device in accordance with an exemplary embodiment. The controller unit is illustrated without a body part and comprises an operating axle 4, a control axle 1, a tripping assembly 50, and connecting means. The controller unit is shown in an on-state.

Figure 2:
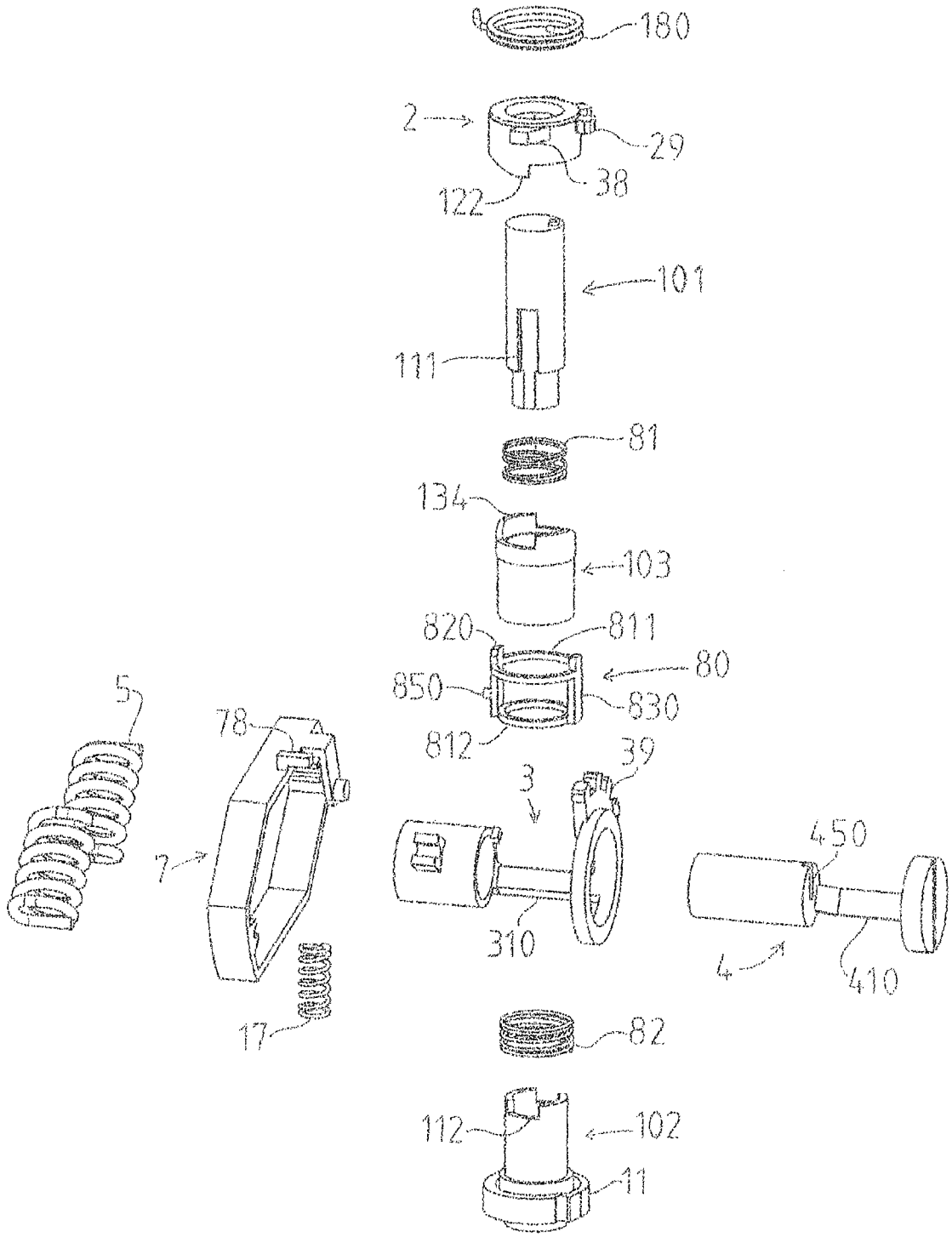
FIG. 2 shows an exploded view of the controller unit in accordance with an exemplary embodiment.

Individual components of the controller unit of FIG. 1 are shown more clearly in an exploded view of FIG. 2.

The operating axle 4 is turnable between an open position and a closed position in relation to the body part. The operating axle 4 is arranged to be functionally connected to contacts of the switching device to adjust their state between the closed position and the open position. In a typical embodiment, the operating axle 4 is arranged to be connected to the main axis of the switching device such that the open position of the operating axle 4 corresponds to the open position of the contact means of the switching device and the closed position of the operating axle 4 corresponds to the closed position of the contact means.

The control axle 1 includes a first axle part 101 and a second axle part 102. The first axle part 101 is arranged to be turned about its turning axis in relation to the body part, and has four positions: test position, off-position, trip position and on-position. The first axle part 101 is arranged to be turned by a user. In an exemplary embodiment, the user can turn the first axle part 101 by means of a control handle fixed to the first axle part 101 or a control motor connected to the first axle part 101.

The controller unit is provided with a return spring 180, the first end of which is attached to the first axle part 101, as shown in FIG. 1, and the second end of which is arranged to be attached to the body part of the controller unit. The return spring 180 is a torsion spring arranged to exert on the first axle part 101 a torque, which tends to return the first axle part 101 to the off-position if the first axle part 101 has been deflected therefrom.

Figure 7:
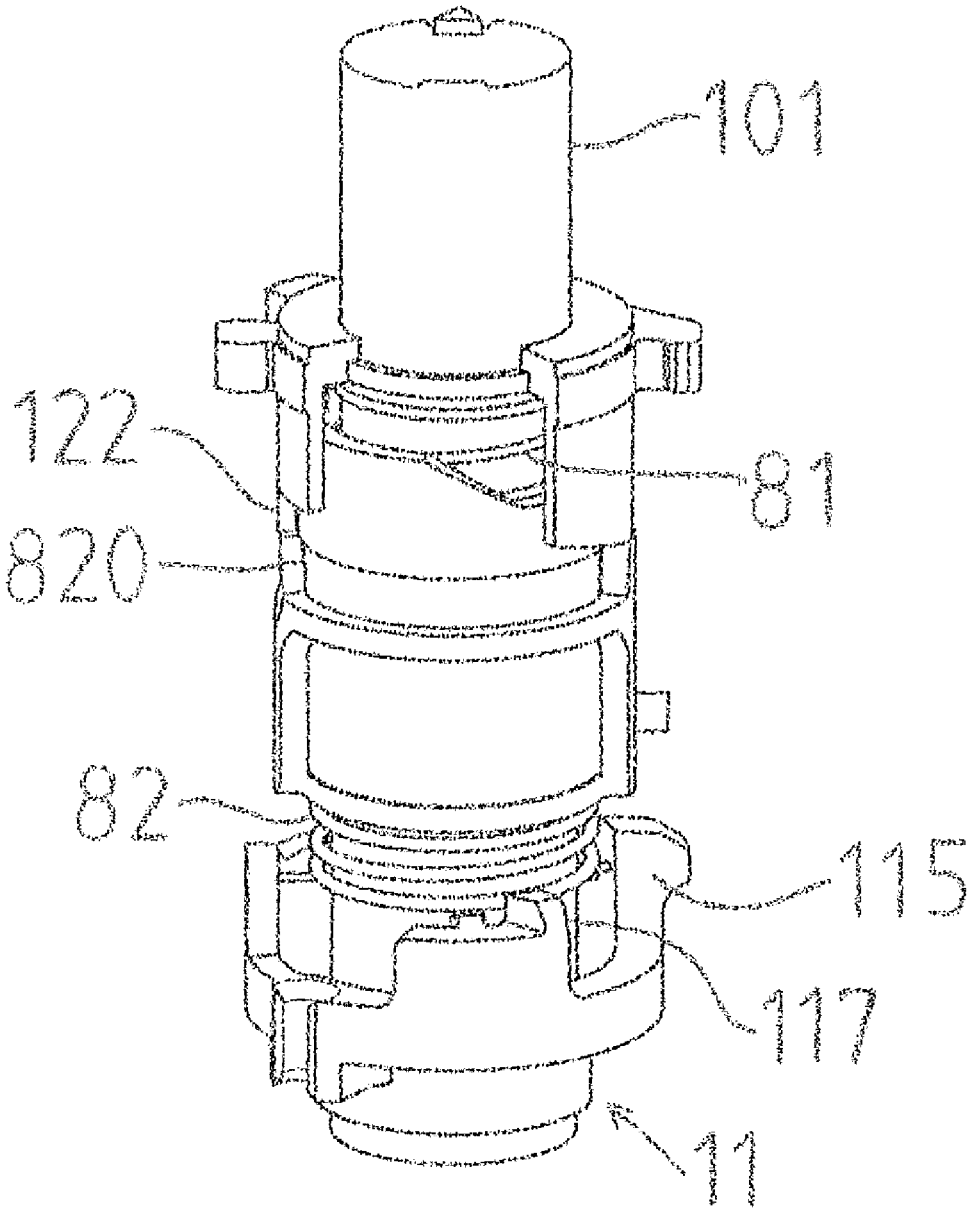

The second axle part 102 is arranged to be turnable about its turning axis in relation to the body part, and can have three positions: an off-position, a trip position, and an on-position. The second axle part 102 is functionally connected to the operating axle 4 to turn the operating axle 4 between the open position and the closed position. The lower part of the second axle part 102 is provided with an actuator 11, which is arranged to be in contact with the operating axle 4 in order to transmit torque from the second axle part 102 to the operating axle 4. The actuator 11 is an integral part of the second axle part 102. Means by which the actuator 11 is arranged to turn the operating axle 4, are shown in FIG. 7.

The controller unit is provided with two working springs, the first end of each working spring is supported on the actuator 11 and the second end is supported on the body part of the controller unit. Working springs 710 are illustrated in FIG. 1. The working springs 710 are arranged to selectively exert torque on the actuator 11. When the second axle part 102 is in the off-position, the torque exerted on the second axle part 102 by the working springs 710 tends to prevent the second axle part 102 from transitioning from the off-position to the on-position, and when the second axle part 102 is in the on-position, the torque exerted on the second axle part 102 by the working springs 710 tends to prevent the second axle part 102 from transitioning from the on-position to the off-position. The working springs 710 thus have a dead point between those positions of the actuator 11 which correspond to the off-position and on-position of the second axle part 102. The working springs 710 can exert on the second axle part 102 a torque that is essentially bigger than the torque the return spring 180 is able to exert on the first axle part 101.

The turning axes of the first axle part 101 and second axle part 102 converge, which means that the first axle part 101 and the second axle part 102 are arranged to turn about a common turning axis. The first axle part 101 and the second axle part 102 are mounted one after another along the common turning axis. The first axle part 101 and the second axle part 102 are mounted such that each is immovable along the axis in relation to the body part.

The tripping assembly 50 comprises a tripping axle 3, a tripping frame 7, two tripping springs 5, a frame spring 17, and locking means. The tripping assembly 50 has a trip state and a tensioned state. During a tensioning event the tripping assembly 50 is arranged to transition from the trip state to the tensioned state and in a tripping event from the tensioned state to the trip state. The tripping assembly 50 is functionally connected to the operating axle 4 via the tripping axle 3 in such a manner that the tripping event of the tripping assembly 50 is able to turn the operating axle 4 from the closed position to the open position.

The tripping axle 3 is arranged to turn between a trip position and a tensioned position in relation to the body part. The tripping axle 3 is mounted coaxially with the operating axle 4 in such a manner that the tripping axle 3 is located further out than the operating axle 4. The common turning axis of the tripping axle 3 and operating axle 4 is perpendicular to the turning axis of the first axle part 101 and second axle part 102. The common turning axis of the tripping axle 3 and operating axle 4 intersects the turning axis of the first axle part 101 and second axle part 102. Both the tripping axle 3 and the operating axle 4 include two end components connected by two axial supports, which are arranged to receive the control axle between them. FIG. 2 shows one axial support 310 for the tripping axle 3 and one axial support 410 for the operating axle 4 in illustrating the state arranged for the control axle.

During the tripping event, the tripping axle 3 turns the operating axle 4 directly by means of the functional connection between the tripping axle 3 and the operating axle 4. Thus, the force is not transmitted from the tripping axle 3 to the operating axle 4 via the control axle 1. The functional connection between the tripping axle 3 and the operating axle 4 is arranged such that when the tripping axle 3 is in the tensioned position, the operating axle 4 may freely turn between the open position and the closed position without the tripping axle 3 needing to turn.

Figure 8:
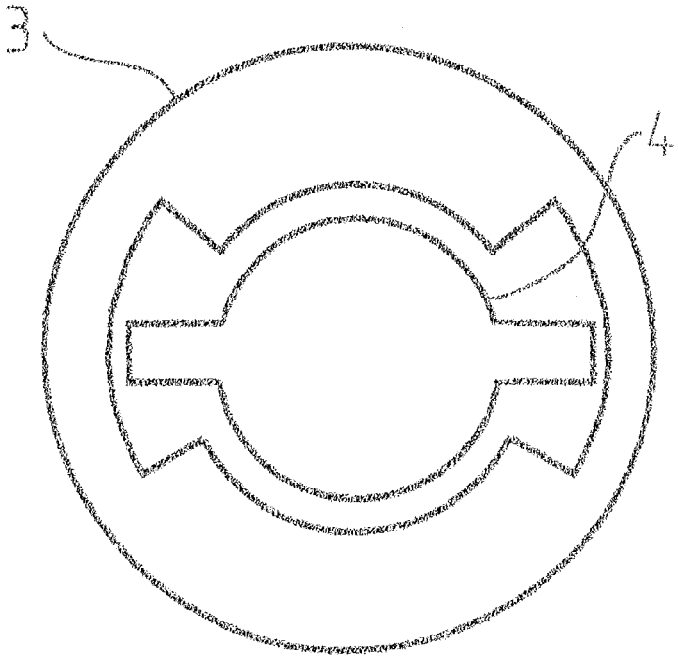
FIG. 7 shows a sectional view of the control axle assembly of the controller unit in accordance with an exemplary embodiment and FIG. 8 shows a functional connection between a tripping axle and an operating axle in accordance with an exemplary embodiment

FIG. 8 illustrates a functional connection between the tripping axle 3 and the operating axle 4 in accordance with an exemplary embodiment.

The tripping frame 7 is arranged to turn between the trip position and the tensioned position in relation to the body part. The turning axes of the tripping axle 3, tripping frame 7 and operating axle 4 substantially converge, which means that the tripping axle 3, the tripping frame 7 and the operating axle 4 are mounted on the body part substantially coaxially.

Each tripping spring 5 is a pressure spring, one end of which is connected to the tripping frame 7 and the other end is connected to the tripping axle 3. Each tripping spring 5 has a non-tensioned state and a tensioned state. In the tensioned state, more energy is stored in the tripping spring 5 than in the non-tensioned state, and when the tripping spring 5 transitions from the tensioned state to the non-tensioned state energy is released.

The frame spring 17 is a pressure spring, which is connected between the body part and the tripping frame 7 and has a non-tensioned and a tensioned state.

The locking means of the tripping assembly can have a locking state and a trip state. In the locking state the locking means locks the tripping assembly 50 in the tensioned state. The tripping event is started by releasing the locking means to allow the tripping assembly 50 to shift from its tensioned state to the trip state. When the tripping event ends, the locking means are in the trip state. The locking means include a locking lever 6 pivoted at the tripping frame 7 and a locking clamp 10, which are shown in FIG. 1.

The connecting means can have a first mode and a second mode. In the first mode the connecting means connects the first axle part 101 to the tripping assembly 50 functionally such that the turning of the first axle part 101 from the off-position to the on-position causes a tensioning event in the tripping assembly 50. In the first mode the connecting means functionally separates the first axle part 101 from the second axle part 102. In the second mode the connecting means connect the first axle part 101 to the second axle part 102 functionally in such a manner that the turning of the first axle part 101 from the off-position to the on-position makes the operating axle 4 turn from the open position to the closed position. In the second mode the connecting means functionally separates the first axle part 101 from the tripping assembly 50.

The connecting means comprises a connecting sleeve 103, a sleeve guide 80, a first connecting spring 81, and a second connecting spring 82.

The connecting sleeve 103 is a sleeve-like component, which is mounted coaxially to the first axle part 101. The connecting sleeve 103 is arranged to be transferred between the tensioning position and the position of use axially to the first axle part 101 and the second axle part 102.

In its tensioning position, the connecting sleeve 103 functionally separates the first axle part 101 from the second axle part 102, thus preventing the transmission of torque between the first axle part 101 and the second axle part 102. In the figures of this application, the tensioning position of the connecting sleeve 103 is its upper position. In its position of use, the connecting sleeve 103 functionally connects the first axle part 101 to the second axle part 102, thus allowing the transmission of torque between the first axle part 101 and the second axle part 102. In the figures of this application, the position of use of the connecting sleeve 103 is its lower position.

The sleeve guide 80 is arranged to be transferred between the first position and the second position axially to the body part of the controller unit. The first position of the sleeve guide 80 is the upper position and the second position is the lower position. Rotation of the sleeve guide 80 about its axial direction is prevented by the cooperation of a guide pin 850 at the sleeve guide 80 and a guide pin groove 450 in the operating axle 4. The axial direction of the sleeve guide 80 is parallel to the turning axis of the first axle part 101 and second axle part 102.

The sleeve guide 80 is a substantially sleeve-like component comprising two annular parts, each of which is arranged coaxially to the connecting sleeve 103. These annular parts are axially arranged at a distance from one another and connected by two axially extending intermediate supports 830, which are located on substantially opposite sides of the circumference of the annular parts. The outer diameter of the upper annular part 811 is larger than that of the lower annular part 812. The inner diameter of the upper annular part 118 is larger than the outer diameter of the connecting sleeve 103. The inner diameter of the lower annular part 812 is smaller than the outer diameter of the connecting sleeve 103, and the outer diameter of the lower annular part 812 is larger than the inner diameter of the connecting sleeve 103. The lower annular part 812 comprises on its upper surface a first guide supporting surface and on its lower surface a second guide supporting surface. The first guide supporting surface is located against the connecting sleeve 103 and the second guide supporting surface against the actuator 11. When the sleeve guide 80 is in its first, i.e. the upper position, the lower annular part 812 of the sleeve guide, i.e. the annular part closer to the second axle part 102, is in contact with the lower surface of the connecting sleeve 103 via its first guide supporting surface.

The first connecting spring 81 is a pressure spring, and it is functionally located between the first axle part 101 and the connecting sleeve 103, thus exerting on the connecting sleeve 103 a force, which tends to move the connecting sleeve 103 towards the position of use, if it has been deflected therefrom. One of the functions of the first connecting spring 81 is to prevent the connecting sleeve 103 from moving to its tensioning position due to gravitation when the controller unit is upside down, i.e. in a position where the second axle part 102 is located higher than the first axle part 101.

The second connecting spring 82 is a pressure spring and it is functionally located between the second axle part 102 and the sleeve guide 80, thus exerting on the sleeve guide 80 a force which can move the sleeve guide 80 towards the first position, if it has been deflected therefrom. The second connecting spring 82 is substantially stiffer than the first connecting spring 81, and thus the elastic constant of the second connecting spring 82 is substantially higher than the elastic constant of the first connecting spring 81. Both the first connecting spring 81 and the second connecting spring 82 have a non-tensioned state and a tensioned state so that in the non-tensioned state, the length of the spring is greater than the spring length in the tensioned state, and thus the spring force caused by the spring is smaller in the non-tensioned state than in the tensioned state.

The connecting member 2 is a sleeve-like member, which is arranged to be turnable between the trip position and the tensioned position in relation to the body part. The connecting member 2 is coaxial to the first axle part 101 in such a manner that the connecting member 2 is located further out. The connecting member 2 is supported so that it is not able to move axially in relation to the body part. The connecting member 2 functionally connects the tripping axle 3 and the tripping frame 7 both in the final stage of a tensioning event and in the initial stage of a tripping event so that in these cases the tripping axle 3 and the tripping frame 7 turn to opposite directions in relation to one another.

The connecting member 2 comprises, on its outer circumference, three connecting member teeth 29 and one turn tooth 38. The teeth 29 of the connecting member are in a cogwheel connection with the tripping axle teeth 39 provided at the tripping axle 3. The turn tooth 38 is arranged to transmit torque between the connecting member 2 and the tripping frame 7 during tensioning and tripping events. The tripping frame 7 is provided with a turn projection 78, which is arranged to be in contact with the turn tooth 38 in order to transmit torque between the connecting member 2 and the tripping frame 7.

The trip position of the connecting member 2 corresponds to the trip state of the tripping assembly 50, and the tensioned position of the connecting member 2 corresponds to the tensioned state of the tripping assembly 50. The turning of the connecting member 2 from the trip position to the tensioned position thus makes the tripping assembly 50 transfer from the trip state to the tensioned state, and the shift of the tripping assembly 50 from the tensioned state to the trip state makes the connecting member 2 turn from the tensioned position to the trip position.

The lower part of the connecting member 2 is provided with two outer connecting projections 122, each of which protrudes downwards, i.e. towards the sleeve guide 80. Each outer connecting projection 122 comprises a slope-like section at its one peripheral end, the other peripheral end being step-shaped. The outer connecting projections 122 are formed on the circumference of the connecting member 2 substantially opposite to one another.

Figure 3A:
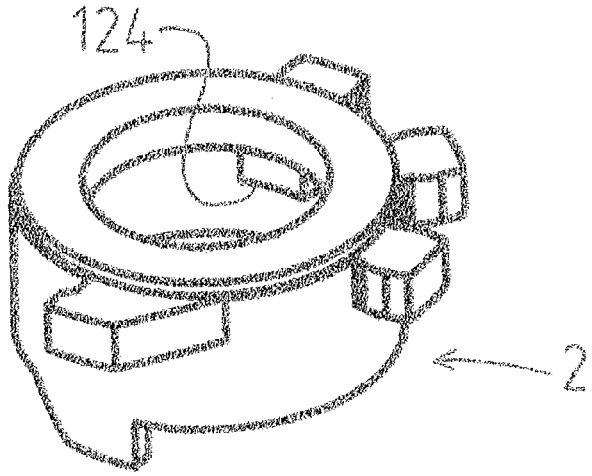
FIG. 3A shows an enlarged view of a connecting member of the controller unit in accordance with an exemplary embodiment

On the inner surface of the connecting member 2 there are two inner connecting projections 124, one of which can be seen in an enlarged view of the connecting member 2 in FIG. 3A. Each inner connecting projection 124 protrudes from the inner surface of the connecting member 2. Both peripheral ends of both inner connecting projections 124 are step-shaped, the peripheral end wall extending on a plane parallel to the axial direction of the control axle.

The inner connecting projections 124 are formed on the inner surface of the connecting member 2 substantially opposite to one another. In the radial direction, the inner connecting projections 124 are located closer to the inside than the outer connecting projections 122.

On the outer surface of the first axle part 101 there are two axle grooves 111, each of which has an open lower part and extends parallel to the axis of the first axle part 101. The lower part of the axle groove 111 refers in this context to the section of the axle groove 111 that is closer to the second axle part 102. The axle grooves 111 are formed on the outer surface of the first axle part 101 substantially on opposite sides in the radial direction.

The upper part of the connecting sleeve 103 is provided with two outer connecting projections 134, each of which protrudes upwards, i.e. towards the connecting member 2. Each outer connecting projection 134 comprises a slope-like section at its one peripheral end, the other peripheral end being step-shaped. The outer connecting projections 134 are formed on the circumference of the connecting sleeve 103 substantially opposite to one another. Each outer connecting projection 134 is arranged to cooperate with the corresponding inner connecting projection 124.

Figure 3B:
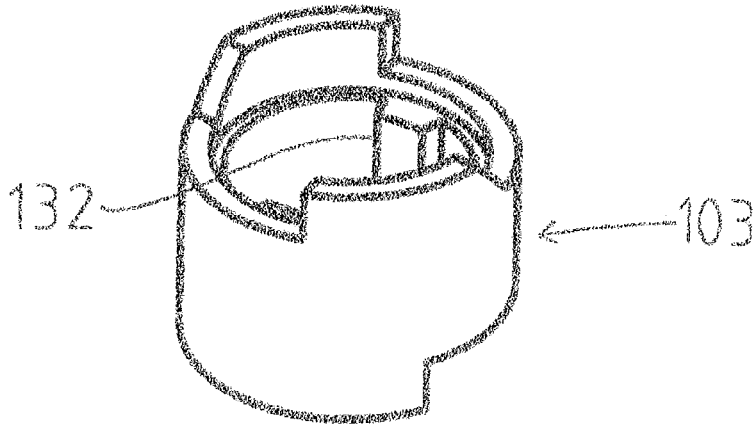
FIG. 3B shows an enlarged view of a connecting sleeve of the controller unit in accordance with an exemplary embodiment

On the inner surface of the connecting sleeve 103 there are two inner connecting projections 132, one of which can be seen in an enlarged view of the connecting sleeve 103 in FIG. 3B. Each inner connecting projection 132 protrudes from the inner surface of the connecting sleeve 103 and extends in the axial direction. The inner connecting projections 132 are formed on the inner circumference of the connecting sleeve 103 substantially opposite to one another. The width of each inner connecting projection 132, i.e. its dimension in the direction of the circumference, is substantially the same as the width of the corresponding axle groove 111. Each inner connecting projection 132 is arranged to cooperate with the corresponding axle groove 111.

The upper part of the sleeve guide 80 is provided with two guide projections 820, each of which protrudes upwards, i.e. towards the connecting member 2. The guide projections 820 are formed on the circumference of the sleeve guide 80 substantially opposite to one another. Each guide projection 820 is arranged to cooperate with the corresponding outer connecting projection 122.

At the upper part of the second axle part 102 there are two axle dents 112, each of which has an open upper part and extends downwards parallel to the axis of the second axle part 102. The upper part of the axle dent 112 is a section of the axle dent 112 that is closer to the first axle part 101. The axle dents 112 are located substantially on opposite sides of the second axle part 102 in the radial direction. The width of each axle dent 112, i.e. its dimension in the direction of the circumference, is substantially greater than the width of the corresponding inner connecting projection 132. Each axle dent 112 is arranged to cooperate with the corresponding inner connecting projection 132.

Figure 4:
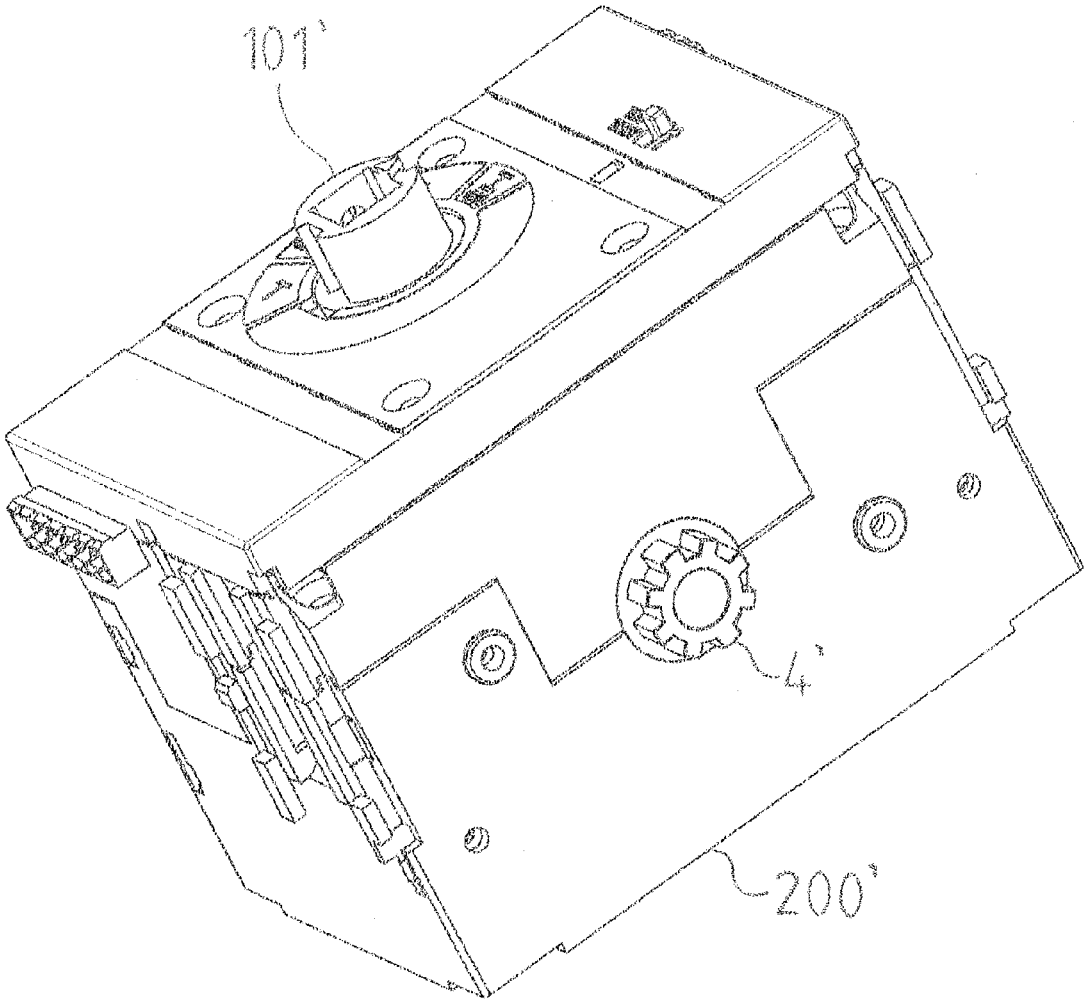
FIG. 4 shows a completely assembled controller unit, in accordance with an exemplary embodiment

FIG. 4 shows a completely assembled controller unit, in accordance with an exemplary embodiment. The controller unit of FIG. 4 includes all components of FIG. 1, but there are differences in the shapes of the details of the components. In FIG. 4 this can be seen in that the shape of the first axle part 101' differs from that of the first axle part 101 shown in FIG. 1. Inside the first axle part 101' there is an axially extending hole with a square cross section, the hole being arranged to fasten a control handle to the first axle part 101'. The control handle is provided with an axle with a square cross section, which is received in the square hole of the first axle part 101'.

Figure 5:
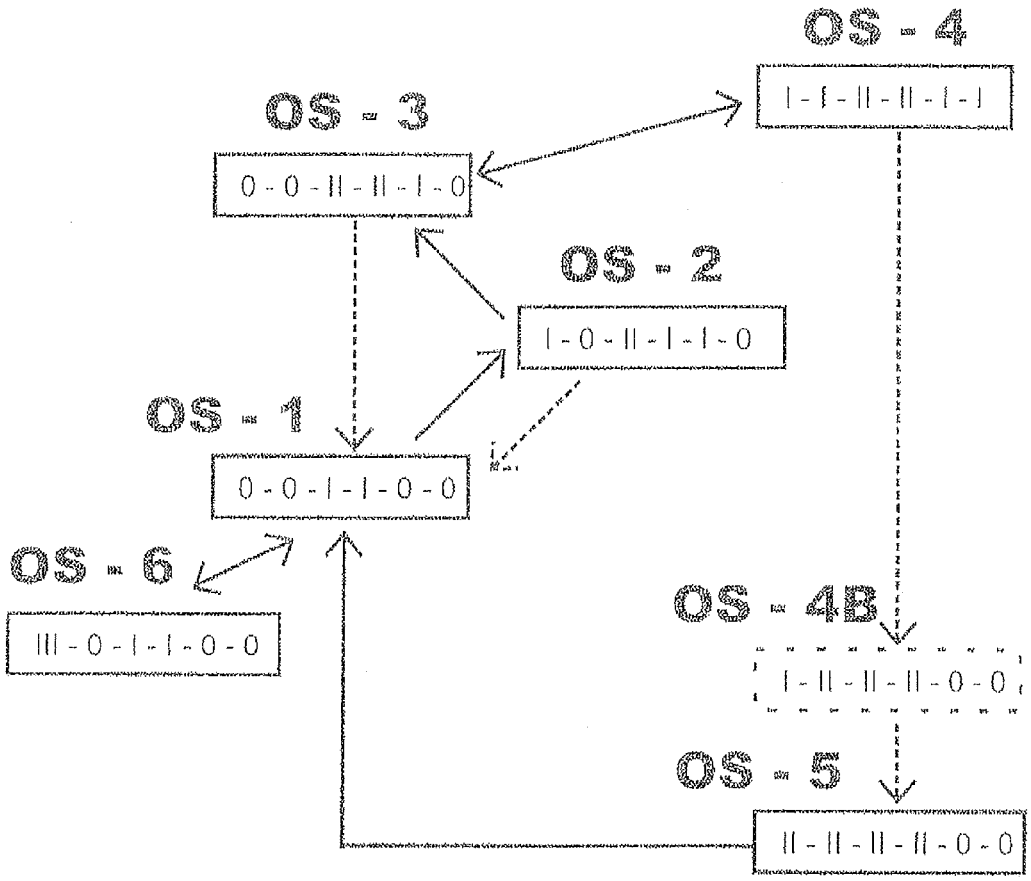
FIG. 5 shows a diagram of the modes of the controller unit in accordance with an exemplary embodiment

FIG. 5 shows a diagram of the modes of the controller unit in accordance with an exemplary embodiment. In the diagram of FIG. 5 there is shown the position of the first axle part 101 of the controller unit, position of the second axle part 102, position of the sleeve guide 80, position of the connecting sleeve 103, state of the tripping assembly 50, and position of the operating axle 4 in seven different modes of the controller unit, which are marked with OS-1, OS-2, OS-3, OS-4, OS-4B, OS-5, and OS-6. FIG. 5 also illustrates how the controller unit transitions between the different modes. A manual shift from one mode to another is illustrated by a continuous arrow, whereas shifts from one mode to another caused by a tripping event are illustrated by discontinuous arrows. Each mode is marked with a mode code comprising six mode symbols separated by hyphens '-'.

The first mode symbol of each exemplary mode code represents the position of the first axle part 101. The first mode symbol can obtain the value '0', when the first axle part 101 is in the off-position, the value 'I', when the first axle part 101 is in the on-position, the value 'II', when the first axle part 101 is in the trip position, and the value 'II', when the first axle part 101 is in the test position.

The second mode symbol represents the position of the second axle part 102. The second mode symbol can obtain the value '0', when the second axle part 102 is in the off-position, the value 'I', when the second axle part 102 is in the on-position, and the value 'II', when the second axle part 102 is in the trip position.

The third mode symbol represents the position of the sleeve guide 80. The third mode symbol can obtain the value 'I', when the sleeve guide 80 is in the first position, and the value 'II', when the sleeve guide 80 is in the second position.

The fourth mode symbol represents the position of the connecting sleeve 103. The fourth mode symbol can obtain the value 'I', when the connecting sleeve 103 is in the tensioning position, and the value 'II', when the connecting sleeve 103 is in the position of use.

The fifth mode symbol represents the state of the tripping assembly 50. The fifth mode symbol can obtain the value '0', when the tripping assembly 50 is in the trip state, and the value 'I', when the tripping assembly 50 is in the tensioned state.

When the tripping assembly 50 is in the trip state, the frame spring 17 is in the non-tensioned state, the tripping frame 7 in the trip position, the tripping springs 5 in the non-tensioned state, and the tripping axle 3 in the trip position. Accordingly, when the tripping assembly 50 is in the tensioned state, the frame spring 17 is in the tensioned state, the tripping frame 7 in the tensioned position, the tripping springs 5 in the tensioned state, and the tripping axle 3 in the tensioned position.

The sixth mode symbol represents the position of the operating axle 4. The sixth mode symbol can obtain the value '0', when the operating axle 4 is in the open position, and the value 'I', when the operating axle 4 is in the closed position. When the operating axle 4 is connected to the contact means of the switching device in order to control them, the value '0' of the sixth mode symbol corresponds to the open position of the contact means and the value 'I' corresponds to the closed position of the contact means.

A mode OS-1 can be the default state of the controller unit. In the mode OS-1, the first axle part 101 and the second axle part are in the off-positions, the sleeve guide 80 in the first position, the connecting sleeve 103 in the tensioning position, the tripping assembly 50 in the trip position, and the operating axle 4 in the open position.

Figure 6A:
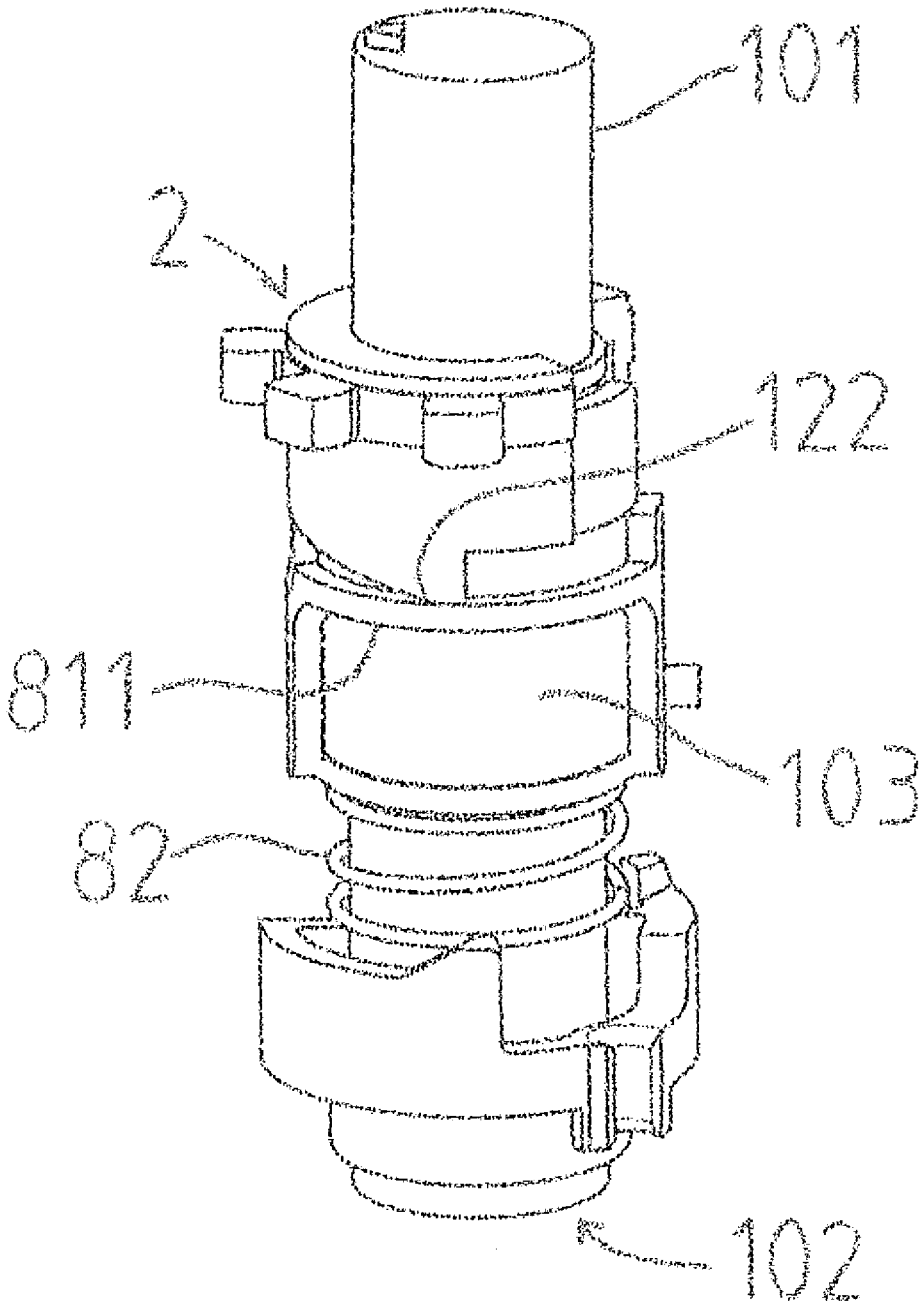
FIG. 6A shows a sectional view of a control axle assembly of the controller unit in accordance with an exemplary embodiment

FIG. 6A shows a sectional view of a control axle assembly of the controller unit in accordance with an exemplary embodiment. The control axle assembly comprises the first axle part 101, second axle part 102, connecting member 2, connecting sleeve 103, sleeve guide 80, first connecting spring 81, and second connecting spring 82. In FIG. 6A, the second connecting spring 82 in the non-tensioned state. The first connecting spring 81, which is covered behind the connecting member 2 and the connecting sleeve 103, is in the tensioned state.

Figure 6B:
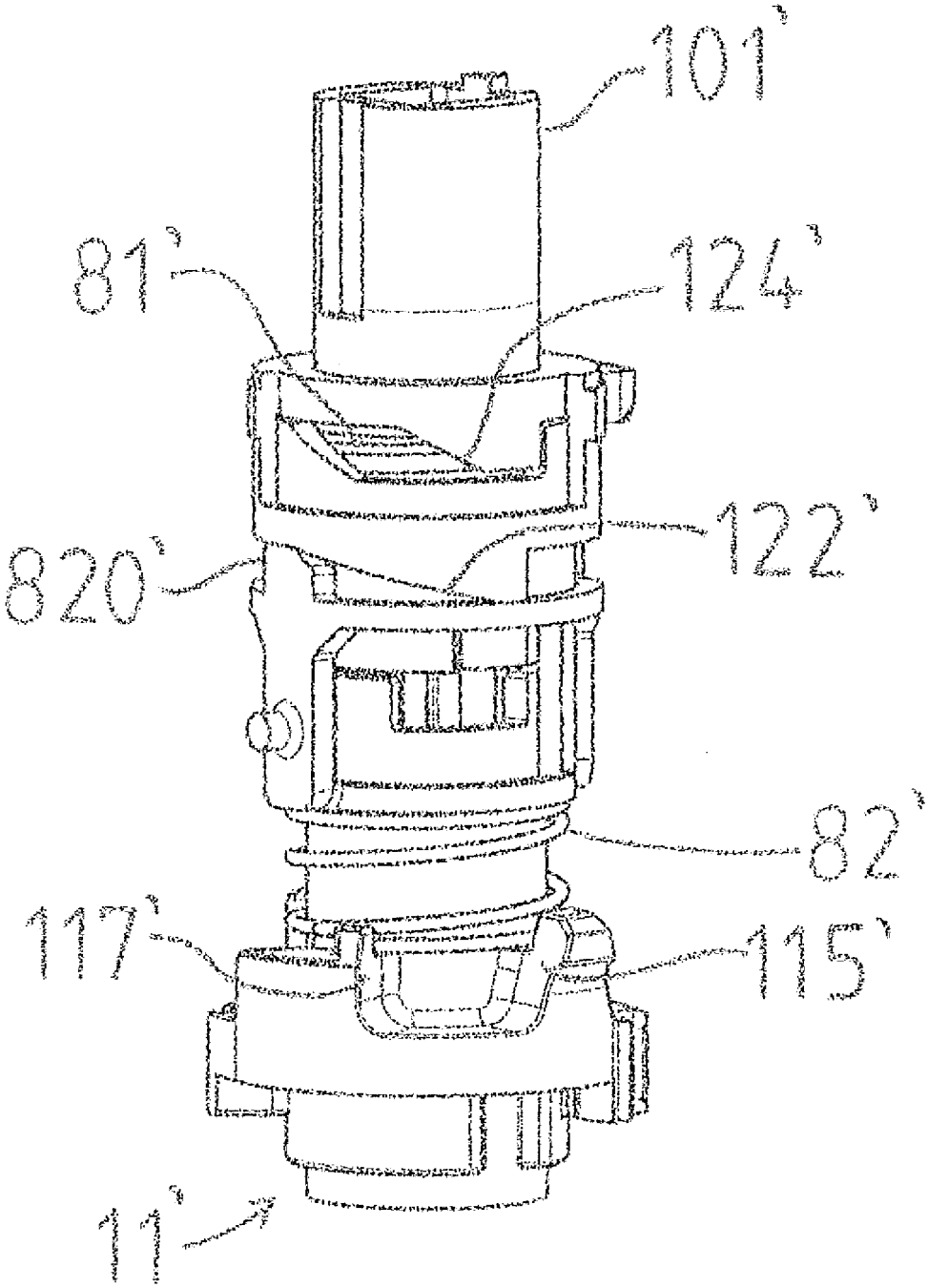
FIG. 6B shows a sectional view of a control axle assembly of the controller unit in accordance with an exemplary embodiment

FIG. 6B shows a sectional view of a control axle assembly of the controller unit in accordance with an exemplary embodiment. In FIG. 6B, the control axle assembly is shown from a different direction than the corresponding control axle assembly of FIG. 6A, and thus FIG. 6B shows slightly different details. FIG. 6B shows, for instance, a part of the first connecting spring 81' in the tensioned state. FIG. 6B also shows that the shape of the inner connecting projection 124' slightly differs from the shape of the inner connecting projection 124 shown in FIG. 3A. The inner connecting member 124' in FIG. 6B comprises a slope-like section at its one peripheral end, the other peripheral end being step-shaped. The slope-like section is located clockwise in relation to the step-shaped end, when the connecting member 2' is viewed from the upper end of the first axle part 101'.

FIG. 6B shows a first turn member 115' and a second turn member 117' provided at an actuator 11' and arranged to establish a functional connection between the actuator 11' and the operating axle 4'. The first turn member 115' and the second turn member 117' are arranged to cooperate with a turn pin of the operating axle (not shown), provided at the operating axle. The turn pin of the operating axle extends downwards from the operating axle and is located between the first turn member 115' and the second turn member 117' in the assembled controller unit.

The shift from the mode OS-1 to the mode OS-2 is carried out by turning the first axle part 101 ninety degrees (90°) clockwise, i.e. from the off-position to the on-position. The axle grooves 111 of the first axle part 101 transmit torque to the inner connecting projections 132 of the connecting sleeve 103 in its tensioning position, whereupon the connecting sleeve 103 turns 90° clockwise with the first axle part 101. The step-shaped ends of the outer connecting projections 134 of the connecting sleeve 103 transmit torque to the inner connecting projections 124 of the connecting member 2 and turn the connecting member 2 ninety degrees (90°) clockwise with the first axle part 101 and the connecting sleeve 103, whereupon the connecting member 2 turns from its trip position to its tensioned position.

When the connecting member 2 turns from its trip position towards its tensioned position, the slope-like sections of the outer connecting projections 122 come into contact with the guide projections 820 of the sleeve guide 80 and press the sleeve guide 80 downwards towards the second position of the sleeve guide 80, simultaneously compressing the second connecting spring 82. When the connecting member 2 turns to the tensioned position, the sleeve guide 80 thus transfers to its second position. However, the connecting sleeve 103 remains in its tensioning position, i.e. upper position, and the first connecting spring 81 remains in its tensioned position, because the inner connecting projections 132 of the connecting sleeve 103 are not aligned with the axle dents 112 of the second axle part 102.

When the mode changes from OS-1 to OS-2, the second axle part 102 remains in its off-position, because the connecting means are in their first mode, where they separate the first axle part 101 from the second axle part 102 functionally. In practice this means that the connecting sleeve 103 is in its first, i.e. upper position, whereby the inner connecting projections 132 are located higher than the axle dents 102 and it is not possible to transmit torque from the inner connecting projections 132 to the axle dents 102.

The turning of the connecting member 2 from its trip position to its tensioned position causes a tensioning event in the tripping assembly. In a tensioning event, the connecting member 2 transmits torque to both the tripping axle 3 and the tripping frame 7. In the tensioning event, the tripping axle 3 turns from the trip position to the tensioned position due to the cogwheel connection between the connecting member teeth 29 and the tripping axle teeth 39.

In the initial stage of the tensioning event, the tripping frame 7 tends to rotate with the tripping axle 3, because the tripping axle 3 applies a torque to the tripping frame 7 via the tripping springs 5. The tripping frame 7 cannot, however, rotate with the tripping axle 3, because the body part applies a supporting force to it, preventing the rotation. Thus, the tripping axle 3 turns in relation to the tripping frame 7, and the tripping springs 5 are compressed.

In the final stage of the tensioning event, the tripping frame 7 turns from its trip position to its tensioned position, pressing the frame spring 17 to the tensioned state. The tripping axle 3 and the tripping frame 7 then turn to opposite directions with respect to one another. The tripping frame 7 turns to the tensioned position as a result of the cooperation of the turn tooth 38 in the connecting member 2 and the turn projection 78 in the tripping frame 7.

The shift from the mode OS-2 to the mode OS-3 can be carried out by means of the return spring 180 so that the torque exerted on the first axle part 101 by the return spring 180 turns the first axle part 101 ninety degrees (90°) counter-clockwise, i.e. from the on-position to the off-position. The axle grooves 111 of the first axle part 101 transmit torque to the inner connecting projections 132 of the connecting sleeve 103, whereupon the connecting sleeve 103 turns ninety degrees (90°) counter-clockwise with the first axle part 101. While the connecting sleeve 103 turns, the inner connecting projections 132 reach a position where each are aligned with the axle dents 112 of the second axle part 102. In this case, the downward force exerted on the connecting sleeve 103 by the first connecting spring 81 can transition the connecting sleeve 103 to its position of use, i.e. lower position, where the lower surface of the connecting sleeve 103 is in contact with the first guide supporting surface of the lower annular part 812 of the sleeve guide 80 in the second position. When the connecting sleeve 103 transitions to its position of use, the first connecting spring 81 transitions to its non-tensioned state.

The transfer of the connecting sleeve 103 to its position of use is ensured by the cooperation of the inner connecting projections 124 of the connecting member 2 and the slope-like sections of the outer connecting projections 134 of the connecting sleeve 103. When the connecting sleeve 103 turns counter-clockwise to the connecting member 2, the inner connecting projections 124 exert a downward force on the outer connecting projections 134 such that the connecting sleeve 103 transfers to its position of use, i.e. lower position.

In other words, the connecting sleeve 103 transfers to its position of use also in cases where there is no first connecting spring 81 or it is not able to exert a sufficient force on the connecting sleeve 103.

The exemplary mode changes from OS-3 to OS-4 by turning the first axle part 101 ninety degrees (90°) clockwise, i.e. from the off-position to the on-position. The axle grooves 111 of the first axle part 101 transmit torque to the inner connecting projections 132 of the connecting sleeve 103 in its position of use, whereupon the connecting sleeve 103 turns ninety degrees (90°) clockwise with the first axle part 101. Since the connecting sleeve 103 is in its position of use, the inner connecting projections 132 transmit torque to the second axle part 102 via the axle dent 112 walls and turn the second axle part 102 to the on-position.

When the second axle part 102 turns to the on-position, the actuator 11 comes into contact with the operating axle 4 and turns it to the closed position.

When the controller unit is in the mode OS-4, the return spring 180 exerts a torque on the first axle part 101 which can return the first axle part 101 to the off-position. However, the first axle part 101 remains in the on-position due to the torque exerted on the actuator 11 by the working springs 710. The connecting sleeve 103 is in the position of use, and thus it functionally connects the first axle part 101 to the second axle part 102, thus transmitting torque from the second axle part 102 to the first axle part 101. The torque exerted on the control axle 1 by the working springs 710 is in the opposite direction and has a substantially greater magnitude than the torque exerted on the control axle 1 by the return spring 180.

The machinery of the controller unit shown in FIG. 1 is in the exemplary mode OS-4. FIG. 7 shows a sectional view of the control axle assembly of the controller unit in accordance with an exemplary embodiment. In FIG. 7, the first connecting spring 81 is in the non-tensioned position and the second connecting spring 82 in the tensioned position.

The shift from the exemplary mode OS-4 back to the exemplary mode OS-3 is carried out by turning the first axle part 101 ninety degrees (90°) counter-clockwise, i.e. from the on-position to the off-position. The axle grooves 111 of the first axle part 101 transmit torque to the inner connecting projections 132 of the connecting sleeve 103 in its position of use, whereupon the connecting sleeve 103 turns ninety degrees (90°) counter-clockwise with the first axle part 101. Since the connecting sleeve 103 is in its position of use, the inner connecting projections 132 transmit torque to the second axle part 102 via the axle dent 112 walls and turn the second axle part 102 to the off-position. When the second axle part 102 turns to the off-position, the actuator 11 comes into contact with the operating axle 4 and turns it to the open position.

The exemplary mode changes from OS-1 to OS-6 by turning the first axle part 101 forty-five degrees (45°) counter-clockwise, i.e. from the off-position to the test position. The axle grooves 111 of the first axle part 101 transmit torque to the inner connecting projections 132 of the connecting sleeve 103, whereupon the connecting sleeve 103 turns forty-five degrees (45°) counter-clockwise with the first axle part 101. The connecting sleeve 103 thus turns along with the first axle part 101, remains in its tensioning position, and does not transmit torque to the other components. In an exemplary embodiment, the first axle part 101 can be provided with actuators (not shown) that connect the auxiliary contacts (not shown) of the switching device from the off-position to the test position when the first axle part 101 is turned to the test position.

The shift from the exemplary mode OS-6 back to the mode OS-1 is carried out by means of the return spring 180 so that the torque exerted on the first axle part 101 by the return spring 180 turns the first axle part 101 forty-five degrees (45°) clockwise, i.e. from the test position to the off-position. The connecting sleeve 103 turns 45°) clockwise with the first axle part 101.

In an alternative embodiment of the disclosure, the return spring mounted between the first axle part and the body part of the controller unit tends to return the first axle part to the off-position only when the first axle part is deflected from the off-position towards the on-position. In such an embodiment, the return spring end on the side of the body part is supported in such a manner that it is able to receive torque in only one direction. While the first axle part is turned to the test position, which is, with respect to the off-position, in a direction opposite to the on-position, the return spring end on the side of the body part turns with the first axle part, whereby the return spring does not exert torque on the first axle part. Instead of a torsion spring, the return spring can be a tension spring or pressure spring or any spring member capable of exerting a torque of a desired magnitude and direction on the first axle part.

The shift from the mode OS-2 to the mode OS-1 is caused by a tripping event. A tripping event also causes the transition from the exemplary mode OS-3 to the exemplary mode OS-1 and from the exemplary mode OS-4 to the exemplary mode OS-5.

During the tripping event, the frame spring 17 transfers from the tensioned state to the non-tensioned state and turns the tripping frame 7 from the tensioned position to the trip position. In the initial stage of the tripping event, the tripping axle 3 is forced to turn to a direction opposite to that of the tripping frame 7 by the connecting member 2. In the initial stage of the tripping event, the turn projection 78 of the tripping frame transmits torque to the connecting member 2 via the turn tooth 38, and the connecting member 2 transmits the torque to the tripping axle 3 by means of the cogwheel connection between the connecting member 2 and the tripping axle 3.

When the exemplary mode changes from OS-2 to the exemplary mode OS-1, the tripping assembly 50 transitions from the tensioned state to the trip state in the above manner, whereby the connecting member 2 turns from the tensioned position to the trip position. When the connecting member 2 turns from the tensioned position to the trip position, the inner connecting projections 124 of the connecting member 2 transmit torque to the outer connecting projections 134 of the connecting sleeve 103 and turn the connecting sleeve 103 ninety degrees (90°) counter-clockwise. The inner connecting projections 132 of the connecting sleeve 103 transmit torque to the axle grooves 111 of the first axle part 101 and turn the first axle part 101 ninety degrees (90°) counter-clockwise. The return spring 180 also exerts on the first axle part 101 a force which turns the first axle part 101 towards the off-position.

When the connecting member 2 turns from its tensioned position towards its trip position, the slope-like sections of the outer connecting projections 122 come into contact with the guide projections 820 of the sleeve guide 80, thus allowing the sleeve guide 80 to rise upwards towards the first position of the sleeve guide 80, lifted by the second connecting spring 82. When the connecting member 2 turns to the trip position, the sleeve guide 80 thus transfers to its first position. The connection sleeve 103 remains in its tensioning position, i.e. its upper position, and the first connecting spring 81 remains in its tensioned position.

When the exemplary mode changes from OS-3 to the exemplary mode OS-1, the tripping assembly 50 transitions from the tensioned state to the trip state, whereby the connecting member 2 turns from the tensioned position to the trip position. When the connecting member 2 turns to the trip position, the sleeve guide 80 transitions to its first position, i.e. its upper position, lifted by the second connecting spring 82 and as a result of the cooperation between the slope-like sections of the outer connecting projections 122 and the guide projections 820 of the sleeve guide 80. The lifting is described above in association with the description of the mode shift from OS-2 to OS-1. When the sleeve guide 80 rises towards its first position, the first guide supporting surface on the upper surface of the lower annular part 812 of the sleeve guide 80 comes into contact with the lower surface of the connecting sleeve 103. When the sleeve guide 80 transfers to its first position, the connecting sleeve 103 transfers to the tensioning position. Since the connecting sleeve 103 does not turn about its axis, the first axle part 101 also remains in its place, i.e. in the off-position.

When the mode changes from OS-4 to OS-5, the tripping assembly 50 transitions from the tensioned state to the trip state, whereupon the tripping axle 3 turns from the tensioned position to the trip position and turns the operating axle 4 from the closed position to the open position by means of the functional connection between the tripping axle 3 and the operating axle 4. The operating axle 4 transmits torque via the turn pin of the operating axle to the first turn member 115 of the second axle part 102 and turns the second axle part 102 to the trip position. Thus, the second axle part 102 does not turn to the off-position but remains in a position between the on-position and the off-position. This is possible because the functional connection between the second axle part 102 and the turn pin of the operating axle is not a cogwheel connection without clearance, but clearance between the second axle part 102 and the operating axle 4 is formed by the distance between the first turn member 115 and the second turn member 117. When the second axle part 102 turns to the trip position, the axle dents 112 move to a position where they allow the first axle part 101 to turn to its trip position. The return spring 180 then makes the first axle part 101 turn to its trip position.

When the mode changes from OS-4 to OS-5, the walls of the axle dents 112 do not transmit torque to the inner connecting projections 132 due to the clearance between the axle dents 112 and the inner connecting projections 132. The clearance is formed, because the width of each axle dent 112, i.e. its dimension in the direction of the circumference, is substantially greater than the width of the corresponding inner connecting projection 132.

When the controller unit is in the exemplary mode OS-5, the return spring 180 exerts on the first axle part 101 a torque which tends to return the first axle part 101 to the off-position. However, the first axle part 101 remains in the trip position, because the connecting sleeve 103 in the position of use functionally connects the first axle part 101 to the second axle part 102, and the working springs 710 exert on the actuator 11 a torque that is in a direction opposite to the torque exerted on the first axle part 101 by the return spring 180.

The shift from the mode OS-5 to OS-1 is carried out by turning the first axle part 101 counter-clockwise from the trip position to the off-position. In the exemplary mode OS-5, the connecting sleeve 103 is in the position of use, thus connecting the first axle part 101 to the second axle part 102 functionally. As a result, when the first axle part 101 is turned counter-clockwise, the second axle part 102 also turns counter-clockwise towards the off-position.

When the first axle part 101 is turned counter-clockwise, the connecting sleeve 103 turns with the first axle part 101 counter-clockwise to the connecting member 2, which remains in its place in the trip position. When the connecting sleeve 103 turns, it reaches a position where each outer connecting projection 134 has passed the corresponding inner connecting projection 124 in a circumferential direction, whereby the inner connecting projections 124 no longer prevent the connecting sleeve 103 from transferring to the tensioning position. In this case, the second connecting spring 82 can transfer the sleeve guide 80 to its first position, which for its part makes the connecting sleeve 103 transition to its tensioning position.

The mode OS-4B shown in the diagram of FIG. 5 is an unstable mode, which can occur when the user holds the handle connected to the first axle part 101 during the tripping event. When the user releases the handle in the exemplary mode OS-4B, the first axle part 101 turns to its trip position, forced by the return spring 180. The fact that the first axle part 101 does not transfer to the off-position is due to the torque exerted on the second axle part 102 by the working springs 710, as was stated in the description of the shift from OS-4 to OS-5.

The controller unit shown in FIG. 4 is a controller unit module of a modular switching device. In addition to a controller unit module, the modular switching device comprises one or more contact modules, which include the contact means of the switching device. Forces that are necessary for changing the state of the contact means are transmitted from the controller unit module to one or more contact modules by means of the operating axle 4'. In the modular switching device, the controller unit module and each contact module comprise their own body parts. The controller unit of the disclosure may also be used in an integrated switching device, such that the controller unit can be mounted on the same body part as the contact means.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

What is claimed is:

1. A controller unit for a switching device, the controller unit comprising:

a body part;

an operating axle, which is turnable between a closed position and an open position in relation to the body part and which is functionally connectable to contacts of the switching device, wherein the operating axle adjusts a state of each contact between the closed position and the open position;

a control axle that includes a first axle part and a second axle part, the first axle part is turned by a user and being turnable between an off-position and an on-position in relation to the body part, the second axle part is turnable between an off-position and an on-position in relation to the body part and is functionally connected to the operating axle to turn it between the open position and the closed position;

a tripping assembly which has a trip state and a tensioned state, and the tripping assembly is functionally connected to the operating axle such that the tripping event of the tripping assembly turns the operating axle from the closed position to the open position; and connecting means for functionally connecting a first axle part to one of a tripping assembly and a second axle part.

2. The controller unit of claim 1, wherein the first axle part and the second axle part turn about a common turning axis and are mounted one after another along the common turning axis.

3. The controller unit of claim 2, wherein the connecting means comprises:

a connecting sleeve that is transferred axially between a tensioning position and a position of use to the second axle part such that, in the tensioning position, the connecting sleeve separates the first axle part from the second axle part to prevent the transmission of torque between the first axle part and the second axle part and, in the position of use, the connecting sleeve connects the first axle part to the second axle part to allow the transmission of torque between the first axle part and the second axle part.

4. The controller unit of claim 3, wherein the first axle part is connected to the connecting sleeve such that the connecting sleeve is transferred from the tensioning position to the position of use by turning the first axle part from the off-position via the on-position back to the off-position.

5. The controller unit of claim 4, wherein the connecting sleeve is functionally connected to the first axle part such that the connecting sleeve and the first axle part turn together in each axial operating positions of the connecting sleeve.

6. The controller unit of claim 5, wherein the connecting means comprises:

a connecting member that is turnable between a trip position and a tensioned position in relation to the body part, the connecting member cooperates with the connecting sleeve, to functionally connect the first axle part to the tripping assembly.

7. The controller unit of claim 6, wherein the connecting member is connected to the tripping assembly such that turning the connecting member from the trip position to the tensioned position causes a tensioning event in the tripping assembly, and a tripping event of the tripping assembly turns the connecting member from the tensioned position to the trip position, and wherein the connecting member is connected to the connecting sleeve such that when the connecting member is in the tensioned position, the connecting sleeve may be transferred from the tensioning position to the position of use by turning the first axle part from the on-position to the off-position.

8. The controller unit of claim 7, wherein the functional connection between the connecting member and the connecting sleeve is provided by at least one inner connecting projection at the connecting member and of at least one outer connecting projection at the connecting sleeve, wherein the at least one inner connecting projection of the connecting member and the at least one outer connecting projection of the connecting sleeve are arranged to cooperate by transmitting torque and axial forces between one another.

9. The controller unit of claim 3, wherein the connecting means also comprises:

a sleeve guide and a second connecting spring, wherein the sleeve guide is transferable along an axis to the body part between a first position and a second position, the sleeve guide comprising at least one guide projection and a first guide supporting surface, wherein the at least one guide projection cooperates with at least one outer connecting projection provided at the connecting member such that when the connecting member turns from the trip position to the tensioned position, the at least one outer connecting projection of the connecting member is in contact with the at least one guide projection, thereby transferring the sleeve guide from the first position to the second position, wherein the sleeve guide cooperates with the connecting sleeve such that a transition of the connecting sleeve from the position of use to the tensioning position is carried out by transferring the sleeve guide from the second position to the first position, during the transition the first guide supporting surface is in contact with the connecting sleeve, forcing the connecting sleeve from the position of use to the tensioning position, wherein the second connecting spring cooperates with the sleeve guide such that if the sleeve guide is deflected from the first position towards the second position, the second connecting spring tends to return the sleeve guide to the first position by using a respective spring force.

10. The controller unit of claim 9, wherein the connecting means comprises a first connecting spring whose elastic constant is substantially lower than that of the second connecting spring, wherein the first connecting spring is arranged to cooperate with the connecting sleeve such that if the connecting sleeve is deflected from the position of use towards the tensioning position, the first connecting spring tends to return the connecting sleeve to the position of use using a respective spring force.

11. The controller unit of claim 1, wherein the first axle part and the second axle part are mounted axially in relation to the body part.

12. The controller unit of claim 8, wherein the connecting means comprises:

a sleeve guide and a second connecting spring, wherein the sleeve guide is transferable axially to the body part between a first position and a second position, the sleeve guide comprising:

at least one guide projection and a first guide supporting surface, wherein the at least one guide projection is arranged to cooperate with at least one outer connecting projection provided at the connecting member such that when the connecting member turns from the trip position to the tensioned position, the at least one outer connecting projection of the connecting member is in contact with the at least one guide projection, and transfers the sleeve guide from the first position to the second position, wherein the sleeve guide is arranged to cooperate with the connecting sleeve such that the transfer of the connecting sleeve from the position of use to the tensioning position results from transferring the sleeve guide from the second position to the first position, during which the first guide supporting surface is in contact with the connecting sleeve, and forces the connecting sleeve from the position of use to the tensioning position, and wherein the second connecting spring is arranged to cooperate with the sleeve guide such that if the sleeve guide is deflected from the first position towards the second position, the second connecting spring tends to return the sleeve guide to the first position by using a respective spring force.

13. The controller unit of claim 12, wherein the connecting means comprises:

a first connecting spring having an elastic constant that is substantially lower than an elastic constant of the second connecting spring, wherein the first connecting spring is arranged to cooperate with the connecting sleeve such that if the connecting sleeve is deflected from its position of use towards its tensioning position, the first connecting spring tends to return the connecting sleeve to the position of use by using the respective spring force.

14. The controller unit of claim 1, wherein during a tensioning event the trapping assembly is arranged to transfer from the trip state to the tensioned state and, in a trapping event from the tensioned state to the trip state.

15. The controller unit of claim 1, wherein in a first mode the connecting means functionally connects the first axle part to the tripping assembly in such that the tensioning event of the tripping assembly may be achieved by turning the first axle part from the off-position to the on-position, and functionally separate the first axle part from the second axle part.

16. The controller unit of claim 15, wherein in a second mode a second mode, connecting means functionally connects the first axle part to the second axle part in such that the turning of the first axle part from the off-position to the on-position makes the operating axle turn from the open position to the closed position, and functionally separates the first axle part from the tripping assembly.

* * * * *